US008651682B2

(12) United States Patent
Davis

(10) Patent No.: US 8,651,682 B2
(45) Date of Patent: Feb. 18, 2014

(54) INSULATED TRANSPARENT PANEL WITH LIGHT EMITTING DIODE LIGHTING FOR USE IN A REFRIGERATED DISPLAY CASE

(75) Inventor: Michael E. Davis, Columbus, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 189 days.

(21) Appl. No.: 13/324,105

(22) Filed: Dec. 13, 2011

(65) Prior Publication Data

US 2012/0320564 A1 Dec. 20, 2012

Related U.S. Application Data

(60) Provisional application No. 61/498,907, filed on Jun. 20, 2011.

(51) Int. Cl.
*F21V 33/00* (2006.01)

(52) U.S. Cl.
USPC ..... 362/92; 362/94; 362/125

(58) Field of Classification Search
USPC ..... 362/92, 249.02, 94, 125
See application file for complete search history.

(56) References Cited

U.S. PATENT DOCUMENTS

| | | | | |
|---|---|---|---|---|
| 2006/0075698 | A1* | 4/2006 | Alessandro | 52/202 |
| 2007/0133192 | A1* | 6/2007 | Alessandro | 362/125 |
| 2011/0080631 | A1* | 4/2011 | Moon et al. | 359/288 |
| 2011/0084627 | A1* | 4/2011 | Sloan et al. | 315/297 |
| 2011/0085321 | A1* | 4/2011 | Eli | 362/147 |
| 2011/0103067 | A1* | 5/2011 | Ago et al. | 362/296.05 |

* cited by examiner

*Primary Examiner* — Evan Dzierzynski

(57) ABSTRACT

One aspect provides a sealed transparent panel for use in a refrigerated display case. In this embodiment, the panel comprises first and second transparent sheets having a sealed space therebetween, and at least one light emitting diode (LED) located within the sealed space and extending along a length of the first and second transparent sheets.

17 Claims, 3 Drawing Sheets

INSULATED TRANSPARENT PANEL WITH LIGHT EMITTING DIODE LIGHTING FOR USE IN A REFRIGERATED DISPLAY CASE

CROSS-REFERENCE TO RELATED APPLICATION

This application claims the benefit of U.S. Provisional Application Ser. No. 61/498,907, filed on Jun. 20, 2011 entitled "Insulated Glass With LED Lights For Refrigerated Display Cases," commonly assigned with this application and incorporated herein by reference.

TECHNICAL FIELD

This application is directed, in general, to a sealed glass panel and, more specifically, to a sealed glass panel having light emitting diode (LED) lighting that can be used in a display case.

BACKGROUND

Displaying products for sale is a major consideration for any retail store. It is desirable to merchants to have their products well lit so that customers can easily see the packages and read labels. Moreover, when the packaging includes bright colors, they display better and are more attractive when the display case is well lit. To address these issues, merchants have had to make certain that either general overhead lighting was adequate or display cases had to include costly canopies containing lighting fixtures. In such systems, considerable time and effort must be expended to replace the bulbs, due to the short life of typical lighting sources, such as incandescent or florescent bulbs. Moreover, in view of the constant drive to reduce energy costs the energy required to operate theses lighting sources is a growing concern.

SUMMARY

One aspect provides a sealed transparent panel. In this embodiment, the panel comprises first and second transparent sheets having a sealed space therebetween, and at least one light emitting diode (LED) located within the sealed space and extending along a length of the first and second transparent sheets.

In another embodiment, the present disclosure provides a refrigerated display case. In this embodiment, the display case comprises a support frame extending around a perimeter of the refrigerated display case. At least one transparent panel is positioned on the support frame and extends along at least one side of the refrigerated display case. The transparent panel comprises first and second transparent sheets having a sealed space therebetween, and light emitting diodes (LEDS) located within the sealed space and that extend along a length of the first and second transparent sheets. The display case also includes a display area located within a perimeter of the support frame.

In yet another embodiment, a method of fabricating a sealed transparent panel is provided. This method comprises placing a first transparent sheet on a work surface, placing light emitting diodes (LEDS) along a length of the first transparent sheet, placing spacers on the first transparent sheet, placing a second transparent sheet on the spacers and over the first transparent panel, wherein the first and second transparent sheets having approximately equal dimensions, and forming a seal between the first and second transparent sheets to form a sealed space therebetween.

BRIEF DESCRIPTION

Reference is now made to the following descriptions taken in conjunction with the accompanying drawings, in which.

DETAILED DESCRIPTION

Figure 1:
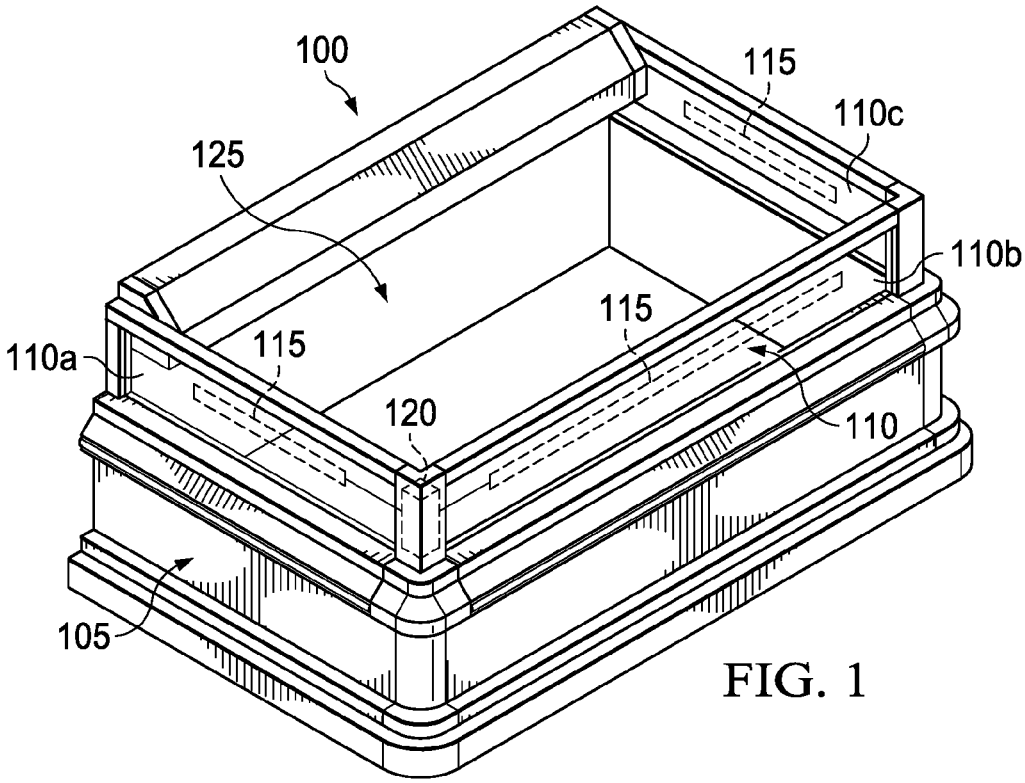
FIG. 1 illustrates one embodiment of a refrigerated display case in which sealed glass panels having LEDs located therein may be employed.

FIG. 1 illustrates one embodiment of a display case 100, such as a refrigerated display case, in which a sealed transparent panel, as presented herein, may be employed. In this particular embodiment, the display case 100 comprises a support frame 105 extending around a perimeter of the display case 100. The support frame 105 may include a number of conventional covers or decorative panels that are typically associated with display cases. Though the illustrated embodiment shows that the display case 100 has only three sides. It should be understood that in other embodiments, it may have any number of geometric configurations having more or less than three sides. Moreover, it should be understood that though the illustrated embodiments discussed here show the panel 110 to be a side panel of a horizontally oriented display case, the panel 110 may also be a door or a sides panel of a vertically oriented display case.

The display case 100 will have at least one transparent panel 110, and will in other embodiments, have more than one such panel, such as panels 110*a*, 110*b*, 110*c*, positioned on the support frame 105. The panels 110*a*, 110*b* and 110*c* extend along the sides of the display case 100, as shown. Though the panel 110 is preferably comprised of glass, in other embodiments, it may be comprised of other transparent materials, such as thick transparent plastic sheets.

The support frame 105 may be of conventional design, and in those applications where the display case 100 is a refrigerated display case, the display case 100 may include a conventional refrigeration system (not shown) housed within the support frame 105. Alternatively, the display case 100 may be remotely connected to a central refrigeration system to which a number of refrigeration display cases may be connected. As explained below in more detail, each of the panels 110*a*, 110*b* and 110*c* comprises two transparent sheets that are spaced apart and sealed. In one embodiment, at least one of the panels 110*a*, 110*b*, or 110*b* uniquely includes one or more light emitting diodes (LEDs) 115 located between individual transparent sheets that make up the panel 110. In one embodiment, the LED(s) 115 may be a string of LEDs that are electrically connected together in series or parallel.

The LED(s) 115 is electrically connected to a power source, and in one embodiment is connected to a power box 120. The power box 120 may be incorporated into the display case 100 itself, as shown, or it may be remotely connected to the display case 100. The power box 120 is configured to provide power to one or more panels 110 for operating the LED(s). The support frame 105 forms a display area 125 located within its perimeter, as shown, and in which items, such as frozen foods, may be displayed.

The LED(s) 115 have a longer operating life than conventional lighting, and they provide excellent lighting for the display area 125. Additionally, the LED(s) consume less power and are more cost efficient, over time, than conventional lighting systems.

Figure 2:
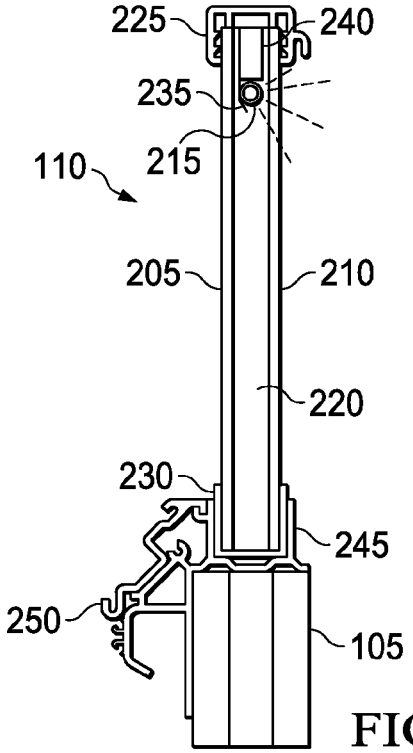
FIG. 2 illustrates a sectional view of one embodiment of a sealed glass panel of FIG. 1.

FIG. 2 illustrates an embodiment where the transparent panel 110 is comprised of opposing glass sheets 205, 210 that rest upon the support frame 105. The glass sheets 205, 210 have approximately the same dimensions, excepting for minor manufacturing variations, and are spaced apart. Further, a seal, such as a butyl rubber or other known sealants, is formed between the glass sheets 205, 210, which forms a sealed spaced 220 between the glass sheets 205, 210. One or more LED(s) 215 are located between the sheets 205, 210 and within the sealed space 220 and may be attached to a cap of the panel 110 or in another manner as mentioned below. In one embodiment, a vacuum exists in the sealed space 220, but in another embodiment, the sealed space 220 contains and an insulative gas, such as argon.

The top end of the panel 110 is capped by a metal cap 225, such as aluminum, and the bottom end has a rubber seal 230 that wraps around the edges of the glass sheets 205, 210, as shown. The space 220 between the sheets 205, 210 is made wide enough to accommodate the thickness of the LED(s) 215 and any other structures associated with the LED(s) 215, which are mentioned below.

In one embodiment, the light from the LED(s) 215 may be reflected by an optional LED reflector 235 located within the sealed space 220 and that extends along the length of the panel 110. In yet another embodiment, the panel 110 may further include a heat sink 240 that is also located between the glass sheets 205, 210 and within the sealed space 220. The heat sink helps conduct the heat generated by the LED(s) 215 from the panel 110. In those embodiments where the LED reflector 235 and the heat sink 240 are both present, the LED reflector 235 may be physically attached to either the LED reflector 235, the heat sink 240 or to both, as shown in the embodiment illustrated in FIG. 2. Additionally, the LED(s) 215 may be attached directly to the heat sink 240, as also shown in FIG. 2. Furthermore, because the LED(s) 215 is located between the glass sheets 205, 210, the heat generated by the LED(s) 215 helps to keep frost from accumulating on the glass sheets 205, 210. This benefit can further reduce manufacturing costs in that heating wires, which are often associated with conventional glass panels, can be eliminated or reduced, thereby reducing not only manufacturing costs, but operational costs as well.

As also seen in FIG. 2, the panel 110 is located within a panel guide 245 that holds the panel 110 in a vertical orientation. Also seen is a conventional molding frame 250 to which covering or decorative panels can be attached.

In one embodiment of a method for fabricating the sealed transparent panel 110, the method comprises placing a first transparent sheet 205 on a work surface. One or more LED(s) 215 are placed along a length of the first transparent sheet 205. In those embodiments where the LED support 235 is present, the LED support structure 235 is placed along the length of the first sheet 205. The entire portion of the length of the first sheet 205 may be spanned by the LED structure 235 or only a portion thereof. The LED 215 is placed on the LED support structure 235.

In those embodiments where the heat sink 240 is present, the LED support structure 235 may be coupled to the heat sink 240. The heat sink 240 may also span the entire length of the first sheet 205 or only a portion thereof. Moreover, it should be noted that the heat sink 240 may also serve as a spacer to keep the sheets 205, 210 spaced at the appropriate distance during the manufacturing process. Spacers are placed on the first transparent sheet and the second transparent sheet 210 is placed on the spacers and over the first sheet 204. The first and second sheets 205, 210 have approximately equal dimensions such that their perimeters are substantially co-extensive with each other when properly positioned with respect to each other. Conventional process may then be used to form a seal between the first and second transparent sheets 205, 210 by using a conventional sealing material, such as butyl rubber or other known sealant materials. The sealing material forms a sealed space between the sheets 205, 210. In certain embodiments, a vacuum may be formed between the sheets 205, 210, to operate as an insulative barrier, or in alternative embodiments, the sealed spaced may have a insulative gas, such as argon placed therein.

Figure 3:
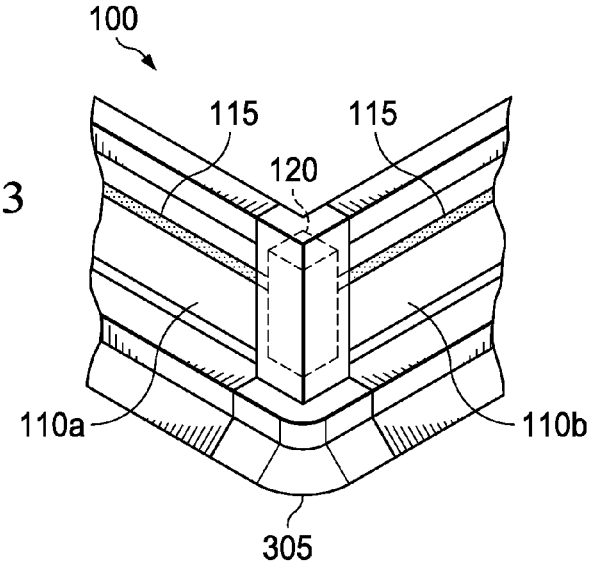
FIG. 3 illustrates a partial view of a corner region of one embodiment of a refrigerated display case having a power box located at the corner region through which the LEDs in the sealed glass panel may be powered.

FIG. 3 illustrates an enlarged view of a corner of the refrigerated display case 100 of FIG. 1, and as such, the same designators are used where applicable. As mentioned above, the display case 100 may include the power box 120. The power box 120 may be of conventional design and have conventional male or female electrical connector ports that are configured to mate with an electrical connector associated with the panels 110*a* and 110*b*. The power box 120 can be hidden by a molding corner 305, as shown, and may be connected to a main power source by way of a cord or cable that runs through a portion of the display case 100.

Figure 4A:
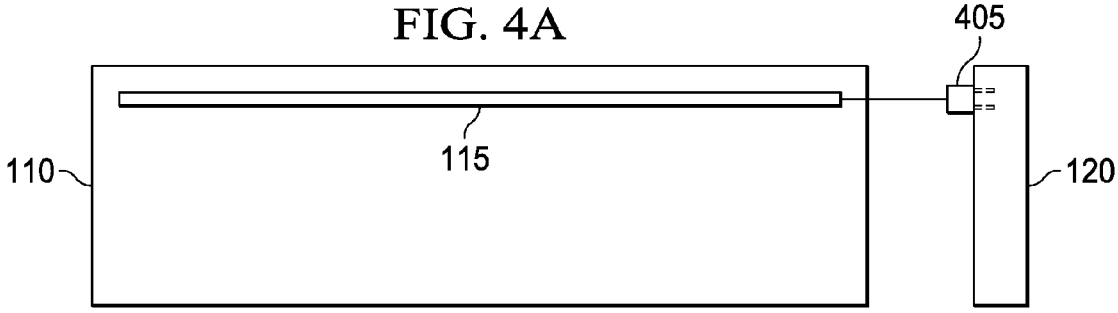
FIGS. 4A-4B illustrates embodiments of the electrical connectors that are associated with the sealed glass panel.
Figure 4B:
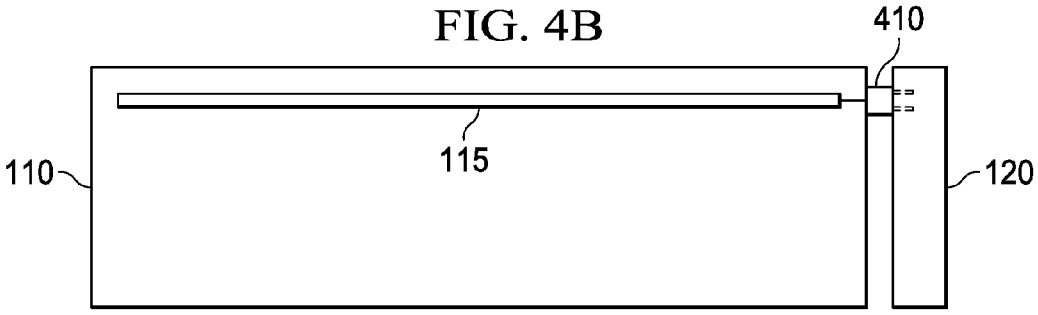

FIGS. 4A and 4B illustrate examples of different electrical configurations that might be used with panel 110 of FIG. 1. FIG. 4A illustrates a connector 405 that includes a flexible pigtail configuration. In this embodiment, the panel can be placed on the frame of the refrigerated display case. The electrical connector 405 can then be connected to the power box 120 and concealed under the molding, as mentioned above regarding FIG. 3. FIG. 4B illustrates a snap-in type of connector 410. In this embodiment, the connector is integrated into the panel 110, such that the electrical connector must be inserted into the corresponding connector of the power box 110 as it is being placed on the support frame of the display case. The above examples are representative only of the types of electrical connector systems that can be used, and it should be understood that many different power coupling configurations can be used to power the LED(s) 115 located within the panel 110.

Figure 5A:
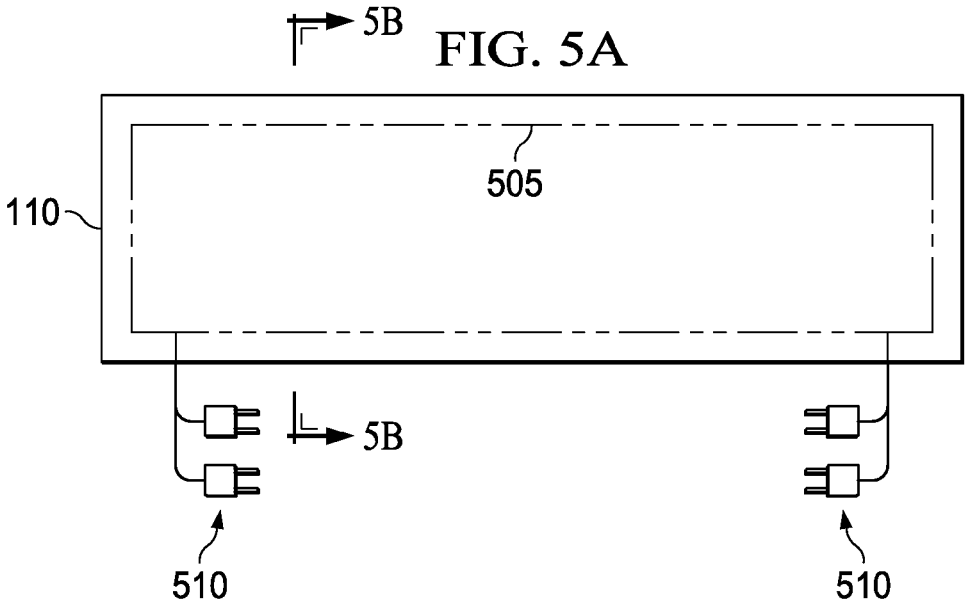
FIGS. 5A-5C illustrate an embodiment of a heating element that may be associated with the sealed glass panel.
Figure 5B:
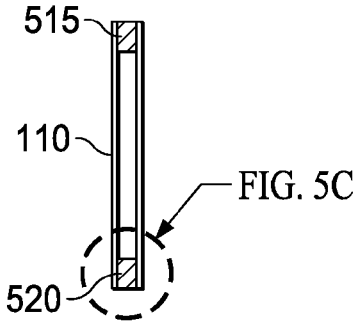
Figure 5C:
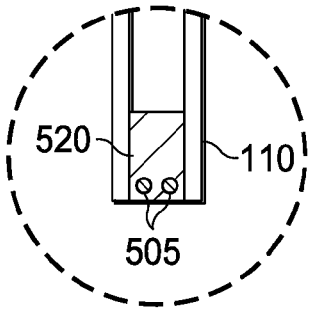

FIGS. 5A-5C illustrate an embodiment of the panel 110 of FIG. 1 that includes a heating wire 505. The heating wire 505 extends around at least a portion of an inside perimeter of the panel 110. The heat wire 505 extends outside the perimeter of the panel 110 and is coupled to one or more electrical connectors 510. In those embodiments in which the display case 100 (FIG. 1) includes the power box 120, the power box 120 may include an additional electrical connector to which the heating wire 505 may be electrically connected. FIG. 5B is a sectional view of the panel 110 taken along line B-B and illustrates spacers 515, 520 that are used to keep the individual sheets 205, 210 (FIG. 2) at the appropriate spacing relative to each other during manufacture of the panel 110. FIG. 5C is an enlarge view of the bottom portion of the panel 110 and illustrates that the wires are located with the spacer 520.

Those skilled in the art to which this application relates will appreciate that other and further additions, deletions, substitutions and modifications may be made to the described embodiments.

What is claimed is:

1. A sealed transparent panel for a refrigerated display case, comprising:

first and second transparent sheets having a sealed space therebetween, and forming a refrigeration case display panel, said refrigeration case display panel supported by a refrigeration display case support frame comprising an upper cap extending along a top perimeter of said refrigeration case display panel and a lower panel guide extending along a lower perimeter of said refrigeration case display panel; and a plurality of light emitting diodes (LEDs) having light emitting ends located within said sealed space and extending along a length of said top perimeter of said refrigeration case display panel, wherein said light emitting ends of said LEDs are oriented in a direction that is parallel with said refrigeration case display panel.

2. The sealed transparent panel recited in claim 1 further comprising a LED support structure located within said sealed space and extending along said length of said top perimeter.

3. The sealed transparent panel recited in claim 1 further comprising a heat sink located adjacent said plurality of LEDs and extending along said length of said top perimeter, said heat sink located in said sealed space.

4. The sealed transparent panel recited in claim 1 wherein a vacuum exists in said sealed space.

5. The sealed transparent panel recited in claim 1 wherein said sealed space contains an insulative gas.

6. The sealed transparent panel recited in claim 5, wherein said insulative gas is argon.

7. The sealed transparent panel recited in claim 1, wherein said plurality of LEDs include an electrical connector electrically coupled to said plurality of LEDs and that extends outside a perimeter of said refrigeration case display panel.

8. The sealed transparent panel recited in claim 1 further comprising a heating element separate from said plurality of LEDs located within said refrigeration case display panel and that extends around at least a portion of an inside perimeter of the refrigeration case display panel.

9. A refrigerated display case, comprising:

a support frame extending around a perimeter of said refrigeration display case;

at least one refrigeration case display panel positioned on said support frame and extending along at least one side of said refrigerated display case, said refrigeration case display panel supported by a refrigeration display case support frame comprising an upper cap extending along a top perimeter of said refrigeration case display panel and a lower panel guide extending along a lower perimeter of said refrigeration case display panel, and configured to be coupled to said support frame of said refrigeration display case, said at least one refrigeration case display panel comprising:

first and second transparent sheets having a sealed space therebetween; and light emitting diodes (LEDS) having light emitting ends and located within said sealed space and extending along a length of said top perimeter of said at least one refrigeration case display panel, wherein said light emitting ends of said LEDs are oriented in a direction that is parallel with said refrigeration case display panel; and a display area located within a perimeter of said support frame.

10. The refrigerated display case recited in claim 9 further comprising a LED support structure located within said sealed space and extending along said length of said top perimeter.

11. The refrigerated display case recited in claim 9 further comprising a heat sink located adjacent said LEDs and extending along said length of said top perimeter, said heat sink located in said sealed space.

12. The refrigerated display case recited in claim 9, further comprising an electrical power box located on said support frame and located at an end of said at least one refrigeration display case panel, said power box having a power receptacle associated therewith.

13. The refrigerated display case recited in claim 12, wherein said LEDs includes an electrical connector electrically connected to the LEDs and that extends outside of said at least one refrigeration display case panel, said electrical connector being configured to cooperatively engage said power receptacle to provide an electrical connection to said LEDs.

14. The refrigerated display case recited in claim 13, wherein said at least one refrigeration display case panel is a first refrigeration display case panel and said refrigerated display case includes at least a second of said at least one refrigeration display case panel and said electrical power box is located adjacent and between ends of said first and second refrigeration display case panels.

15. The refrigerated display case recited in claim 9 wherein a vacuum exists between said sealed space.

16. The refrigerated display case recited in claim 9 wherein said sealed space contains an insulative gas.

17. The refrigerated display case recited in claim 9 further comprising a heating element separate from said plurality of LEDs located within at least one of said first and second refrigeration case display panels and that extends around at least a portion of an inside perimeter of said at least one of said first and second refrigeration case display panels.

* * * * *